US007854695B2

(12) United States Patent
Lightbourne

(10) Patent No.: US 7,854,695 B2
(45) Date of Patent: Dec. 21, 2010

(54) EXERCISE AND THERAPEUTIC APPARATUS

(75) Inventor: Warwick Lightbourne, Auckland (NZ)

(73) Assignee: Clinical Technology (NZ), Ltd., Auckland (NZ)

( * ) Notice: Subject to any disclaimer, the term of this patent is extended or adjusted under 35 U.S.C. 154(b) by 0 days.

(21) Appl. No.: 11/643,900

(22) Filed: Dec. 22, 2006

(65) Prior Publication Data

US 2008/0122278 A1 May 29, 2008

(51) Int. Cl.
*A63B 26/00* (2006.01)

(52) U.S. Cl. ..... 482/142

(58) Field of Classification Search ..... 482/93–100, 482/142, 148; 601/98–100
See application file for complete search history.

(56) References Cited

U.S. PATENT DOCUMENTS 4,114,610 A * 9/1978 Koch ..... 601/24
4,927,139 A * 5/1990 Taltre ..... 482/142
5,100,131 A * 3/1992 Fong ..... 428/112
5,584,786 A * 12/1996 Almeda ..... 482/142
5,897,470 A * 4/1999 Chen ..... 482/123
5,897,472 A * 4/1999 Thulasingam ..... 482/133
5,913,758 A * 6/1999 Nunez ..... 482/142
6,659,923 B2 * 12/2003 Teuscher ..... 482/142
6,726,609 B2 * 4/2004 Kuo ..... 482/143
6,971,977 B1 * 12/2005 Chen ..... 482/140

* cited by examiner

*Primary Examiner*—Fenn C Mathew
(74) *Attorney, Agent, or Firm*—Young & Thompson

(57) ABSTRACT

In its preferred form the invention provides adjustable stretching apparatus for stretching the back, shoulders, and/or the neck, in order to assist with postural and vertebral alignment. A preferred apparatus includes a seat, a headrest positioned above and behind the seat, and a convexly curved reasonbly hard, rigid form separating the seat and headrest. The curved form includes a longitudinal channel defined between two ridges, within which channel the spine is supported when in use. The support is preferably rigid. Provision of legs to raise the apparatus above the ground, and provision of varable head rests and seat, greatly improve the applicability of the apparatus in amelioration of a variety of postural and vertebral alignment problems.

5 Claims, 1 Drawing Sheet

EXERCISE AND THERAPEUTIC APPARATUS

FIELD

Figure 1:
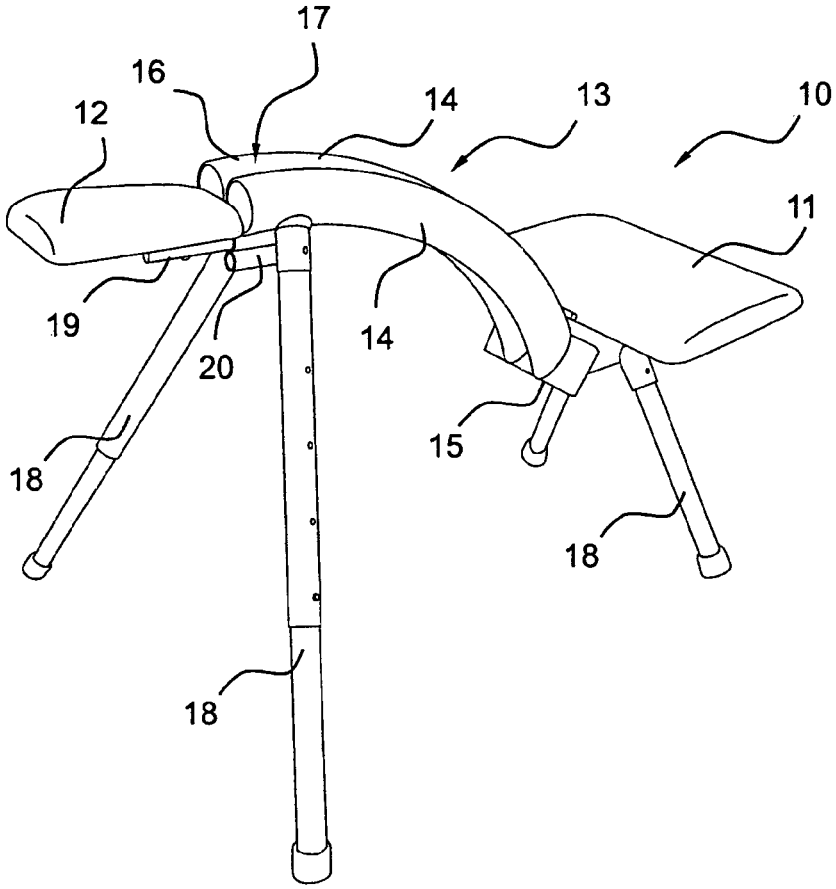

This invention relates to therapeutic apparatus, and exercise equipment, with particular application to overcoming back and neck tension.

BACKGROUND

Back pain or discomfort is a common problem, whether due to injury or misalignment of vertebrae, poor posture, an unsuitable bed, or fatigue resulting from extended periods of seated work or driving. Various postures and exercises have been devised for offering relief, such as lying on the floor with feet and calves elevated on the seat of a chair, crunches (lifting the upper back and shoulders from a face-up or face-down prone position, while leaving the hips and lower body on the floor) and other such stretches. Sometimes apparatus has been used to assist or modify the effect of such a stretch or posture, by providing a form on which the spine is bent or curved. It is notable that few activities cause the back to become curved backwardly.

PRIOR ART

Devices which actually curve the back backwards over a form during a process of alleviating or overcoming back or neck tension are not common. U.S. Pat. No. 6,478,721 to Hunter describes a frame wherein the back is pushed against a globular cushion, but exercise in this instance is applied to the upper and lower abdominal muscles rather than to any part of the spine. Further, the inventor does not expect any useful results if his exercises are performed on apparatus having a non-rigid form that has cushion-like "give". U.S. Pat. No. 5,803,884 to Sharp describes an abdominal exercise machine in which the lower back (92) is pressed against a convex, position-adjustable support (68). Sliding the support forwards or backwards can determine tension in the m. rectus abdominis and hence influence exercise. The lower back does become arched over the support, but no involvement of the m. erectus spinae as described in the present invention is either described or expected.

Problem to be Solved

The postures and exercises currently suggested for relieving back pain or discomfort, and/or strengthening the muscles which support the spine, generally involve the user lying on the floor or other hard surface. Apart from being dusty, cold or uncomfortable, this also involves considerable strain and effort for the user to get down into the appropriate posture on the floor, and then to get back up—particularly if the user has restricted mobility because of the back pain. The present device is particularly though not entirely intended to apply an unusually experienced (in terms of modern life) form of tension to the back muscles, in particular those muscles known as m. erectus spinae.

Object

It is an object of this invention to provide improved apparatus to assist with physiotherapy and stretching, or at least to provide the public with a useful choice in this regard.

STATEMENT OF INVENTION

In one broad aspect the invention provides apparatus to assist with stretching of parts of the body, the apparatus comprising a seat, a headrest positioned above and behind the seat, and a convex form arched between the seat and the headrest.

Preferably the apparatus is supported above the floor on legs, such that the seat is supported at or about knee height in normal use.

Preferably, though not essentially, the legs are of adjustable length.

Preferably the height and angle of the seat is adjustable relative to the convex form.

A preferred seat angle ranges between horizontal to 30 degrees above horizontal, and in one embodiment the change of angle of the seat also results in a change in mean height.

Preferably the height of the headrest is adjustable relative to the convex form and as the height is lowered the neck becomes further elongated.

A preferred range of heights ranges over about 40 mm (1.55 inches).

In another broad aspect the invention provides apparatus to assist with stretching the back, including a convex form having an upper convex surface comprised of at least two parallel ridges comprised of a relatively non-resilient and rigid material.

Optionally the upper convex surface includes irregularities and one preferred irregularity comprises a pattern of dimples comprising rounded or dimpled extensions separated by about 12 mm (0.5 inch).

Preferably the apices of the parallel ridges are spaced about 6.6 cm (2.6 inches) apart.

Preferably the convex surface extends along an arc of about 57 cm (22.5 inches) in length.

Preferably the convex surface extends along an arc of about 80°.

Preferably the upper end of the convex form is substantially horizontal, and the lower end of the convex form is about 10° off vertical.

In one preferred version the convex form comprises a pair of curved pipes firmly attached to each other along one side, so that the convex form is comprised of a pair of parallel arched cylinders.

A more general preferred form is comprised of parallel metal pipes, and optional forms presenting a comparable convex surface include forms made of pressed or extruded metal or plastics, or shaped wood.

In another broad aspect the invention provides a form for stretching a person's back in a backward direction for a period of time, placing some of the muscles of the back or spine or neck (especially but not only in particular those muscles known as m erectus spinae) in a state of tension.

Preferred Embodiment

The description of a preferred form of the invention to be provided herein, with reference to the accompanying drawings, is given purely by way of example and is not to be taken in any way as limiting the scope or extent of the invention.

Throughout this specification unless the text requires otherwise, the word "comprise" and variations such as "comprising" or "comprises" will be understood to imply the inclusion of a stated integer or step or group of integers or steps but not the exclusion of any other integer or step or group of integers or steps.

DRAWINGS

FIG. 1: shows a preferred embodiment of the invention in side perspective view.

Figure 2:
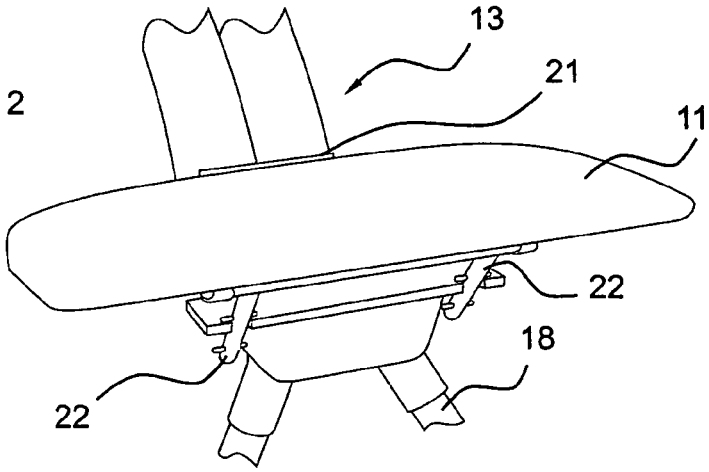

FIG. 2: shows detail of the embodiment of FIG. 1 in end view (the head rest).

Figure 3:
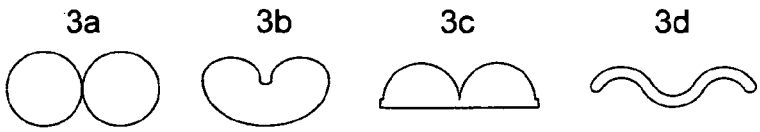

FIG. 3: shows variations of the curved back support, in cross-section.

In one preferred form the invention provides a back-stretching form which can be adjusted to suit people of different heights and body shapes, and which is elevated off the floor for ease of use. As shown in FIG. 1, the form 10 includes a seat 11 and a headrest 12 positioned above and behind the seat, with a convex curved back support 13 between the two. The back support 13 is formed (at least in the prototype) from two parallel, curved tubes 14, 14, each preferably about 6 cm (2.4 inches) in outside diameter, which arch back from the seat 11. At the base 15 where they connect to the seat 11 the tubes 14 are nearly vertical, and at the top 16 where they connect to the headrest 12 they are substantially horizontal, arching through about 80° over a distance of about 50 cm (20 inches), or slightly less than the average length of the adult spine from tailbone to neck. (Dimensions given are by way of example and may be modified for example according to population average sizes, or population age-related effects).

To stretch the back, a user sits on the seat 11 and reclines back over the form 13 until the head is able to rest on the headrest 12. The spine lies along the channel 17 formed between the two tubes 14, and is supported by the tubes on either side so that no pressure is applied to the dorsal processes of the vertebrae themselves. The arms and shoulders typically hang downwardly on either side. By stretching back over the curve of the form 13 the back is stretched evenly along its length, and because the user starts from a seated position rather than lying prone or at floor level, it is relatively easy to get up again.

The inventor has found that the curved surface in contact with the user's back should be relatively hard, such as is provided by a wooden, firm plastics, or metal form. A soft surface such as provided by a pneumatic cushion is not particularly useful for most persons.

The form 10 is supported on legs 18, which (in the prototype) are telescopic or otherwise adjustable, so that the form can be positioned at a height which suits a particular user. The headrest 12 is preferably also adjustable, being mounted on a slideable rod 19 which can be fastened into any one of three sockets 20 to give different heights and distances from the upper end 16 of the curved back support 13, to suit different users and give different stretches. (Other ways to mount the headrest at a variety of heights may be substituted).

The seat 11 is also adjustable, as shown particularly in FIG. 2. The seat 11 is connected at the base 15 of the curved back support 13 with a hinge 21 and adjustable struts 22, so that the outer edge of the seat can be pivotally raised and lowered to vary the angle of the seat relative to the curved back support 13. By this means a user can adjust the seat to suit his or her height and leg length, to allow sitting with the feet flat on the floor and the legs at a comfortable angle while using the apparatus. The inventor calls this device the "Chiroflex"™. It is an exercise or therapeutic device for releasing back, neck and shoulder tension to assist postural and vertebral alignment. The solid, strategically positioned back support including means for reverse-arched positioning enables the user to progressively proceed through stages of kinetic movement at different angles when lying and unrolling on the apparatus. Using body weight and kinetic movement over the bilateral curved back support releases muscular tension and also gently permits natural adjustment of displaced vertebrae. The seat, neck and the front legs of the apparatus can each be adjusted to three different height positions from commencement to an advanced position. The angle of the seat also raising or lowering of the neck rest or legs determines the angle of body weight pressure to assist the kinetic mobility objective and also identifies and releases each individual area of restriction in the back trunk, shoulder or neck. Positioning of the arms; either unrolling at the sides or above also helps alleviate shoulder and neck tension. The device may for example be sold for use in the home, in a gymnasium, or at a physiotherapist's premises.

VARIATIONS

While the embodiment described above is currently preferred, it will be appreciated that a wide variety of variations might be made within the general spirit and scope of the invention. In particular, the adjustment mechanisms illustrated could be changed to any of a variety of common systems by which the seat can be raised or lowered, the headrest adjusted or the length of the legs altered, to suit different needs or purposes, possibly incorporating pneumatic springs or other assisters for ease of use. The curved form 13 could also be made adjustable with a telescoping arrangement or other means to adjust the horizontal distance between the tubes 14.

The curved form 13 is preferably formed from two parallel tubes as described above, but it will be appreciated that a variety of other constructions could be used to create the paired ridges and intermediate channel provided by the apparatus. FIG. 3 shows the curved form 13 in cross-section, 3*a* being the form as illustrated in FIGS. 1 and 2, and 3*b* 3*c* and 3*d* illustrating alternative cross-sections which could provide the same or a similar upper convex surface, having a channel 17 defined between two parallel convex ridges. 3*b* and 3*d* would be easier to clean. A corrugated surface as shown in 3*d*, but having a number of ridges defining more than one channel might alternatively be used, although it is considered preferable at present that the arms and shoulders are able to fall unimpeded to either side of the curved form. The corrugated surface of FIG. 3*d* may be relatively easy to make. It could be formed by rolling a metal sheet between corrugated rollers, or by extruding a plastics or aluminium form, or by rotational moulding of plastics. Alternatively it could be made from wood by using a cutter to cut a corrugated section as shown (at least) in the upper profile of FIG. 3*d* around a curved provide that may be made by wood-bending procedures from a flat beam or sheet, or laminate (plywood) according to techniques well known to those skilled in the art. Some of these variations are more for appearance than function.

The prototype does not include any means to alter the sharpness of the curvature of the back support, although a form of curve adjustment from time to time would be useful in some cases. One way to achieve an alterable curve is to make the back support in a flexible metal or plastics material which is firmly held in an adjustable manner by a simple frame. The frame may include intermediate struts so that there is no "give" during use.

Te inventor also believes that providing a dimpled surface (resembling one that would be made by placing an array of marbles each about 12 mm (½ inch) diameter over a surface, separated by about 12 mm) on the contact area would assist in the action of the therapeutic apparatus.

The legs are preferably arranged in a simple sawhorse arrangement as shown, for stability and strength, but it will be appreciated that two T-form legs, or a variety of other constructions, could be used instead. Other features such as armrests or footrests might also be added without departing from the scope of the invention as set forth in the following claims.

I claim:

1. An exercise and therapeutic apparatus to assist with stretching of parts of a user's body especially muscles adjacent backbone, and to assist with natural adjustment of displaced vertebrae, the apparatus comprising:

an adjustable seat;

an adjustable headrest positioned above and behind the adjustable seat; and an arched convex form connecting the adjustable seat to the adjustable headrest, wherein the apparatus being supported above a floor on adjustable legs, the arched convex form having an exposed outer convex surface comprised of two parallel, spaced-apart ridges, each ridge being comprised of a non-resilient and rigid material, the two ridges providing a rigid convex channel that, when in use, supports the user's back along each side of the backbone, and the width of said rigid convex channel is about 2.6 inches (6.6 cm).

2. The apparatus as claimed in claim 1, wherein the upper end or headrest end of the arched convex form is substantially horizontal and the convex surface extends along an arc of about 80° down to the lower or seat end of the arched convex form.

3. The apparatus as claimed in claim 2, wherein the adjustable seat is pivotally mounted along one edge on to the remainder of the apparatus, the angle of the adjustable seat is adjustable between horizontal to 30 degrees above horizontal, and the change of angle of the adjustable seat also results in a change in mean height of the adjustable seat.

4. The apparatus as claimed in claim 2, wherein the height of the adjustable headrest is adjustable over about 40 mm (1.6 inches) relative to the arched convex form so that as the height is lowered the user's neck becomes further elongated.

5. The apparatus as claimed in claim 2, wherein the arched convex form comprises a parallel pair of curved cylindrical shapes firmly attached to each other along one side.

* * * * *